United States Patent [19]

Sakurai et al.

[11] Patent Number: 4,873,532

[45] Date of Patent: Oct. 10, 1989

[54] ANTENNA APPARATUS FOR A VEHICLE

[75] Inventors: Kaoru Sakurai, Kanagawa; Harunori Murakami, Tokyo; Hikaru Mizukami; Kazuhisa Fujita, both of Kanagawa, all of Japan

[73] Assignee: Nippon Sheet Glass Co., Ltd., Japan

[21] Appl. No.: 251,347

[22] Filed: Sep. 29, 1988

[30] Foreign Application Priority Data

Oct. 7, 1987 [JP] Japan ..... 62-153644[U]

[51] Int. Cl.[4] ..... H01Q 1/38

[52] U.S. Cl. ..... 343/713; 343/711

[58] Field of Search ..... 343/711, 712, 713

[56] References Cited

U.S. PATENT DOCUMENTS 3,599,214 8/1971 Altmayer ..... 343/713
3,634,864 1/1972 Trachtenberg ..... 343/713
3,646,561 2/1972 Clarke ..... 343/713
4,721,964 1/1988 Sato et al. ..... 343/713

FOREIGN PATENT DOCUMENTS 2014642 10/1971 Fed. Rep. of Germany ..... 343/713

*Primary Examiner*—Rolf Hille
*Assistant Examiner*—Doris J. Johnson
*Attorney, Agent, or Firm*—Jones, Day, Reavis & Pogue

[57] ABSTRACT

An antenna element conductor is formed on a transparent insulating film. An adhesive is applied to the rear surface of the film. A connector is provided to a feeder terminal. A print antenna comprising the film and the antenna conductor can be attached to a glass surface, and a position of the antenna on the window glass can be desirably selected so as to obtain good antenna characteristics.

8 Claims, 6 Drawing Sheets

820 MHz

840 MHz

860 MHz

880 MHz

ANTENNA APPARATUS FOR A VEHICLE

BACKGROUND OF THE INVENTION

1. Field of the Invention

The present invention relates to an antenna apparatus for a vehicle, which is disposed on a window glass of a vehicle.

2. Prior Art

When a radio receiver, television receiver, or vehicle telephone set is installed in a vehicle to receive a radio or television broadcast signal or to communicate with a person outside the vehicle, a special-purpose antenna adjusted to a specific frequency band to be used must be mounted on the vehicle. For example, a rear pole antenna or a glass print antenna is mounted on the vehicle as an antenna for a vehicle telephone band. The rear pole antenna has a rod-like conductor of a length corresponding to the vehicle telephone band. The rod projects on the rear portion of the vehicle body. The glass print antenna is formed by printing and baking a conductive paste on the window glass of the vehicle to have a loop or semi-loop shape corresponding to the wavelength of the vehicle telephone band.

Since the rear pole antenna projects from the vehicle, this impairs the outer appearance of the vehicle. Mounting of the antenna is so cumbersome that a user cannot easily mount the rear pole antenna. The rear pole antenna sometimes disturbs washing of the vehicle.

In contrast to this, since the glass print antenna is provided on the surface of the window glass of the vehicle, the above drawbacks are not caused. However, since the conductive paste is printed and baked on the surface of the window glass of the vehicle, it cannot be easily mounted. The glass print antenna is normally provided on the surface of the rear window glass. However, heater wires for defogging the surface are often also arranged on the rear window glass. For this reason, the position and area where the glass print antenna is arranged are limited, and the position and area for obtaining good antenna performance cannot be desirably selected.

SUMMARY OF THE INVENTION

It is a general object of the present invention to allow good vehicle communication without a fixed special-purpose antenna.

It is a specific object of the present invention to provide a vehicle antenna which does not project from a vehicle body and can be very easily installed.

It is another object of the present invention to provide a print antenna using a window glass as an insulating plate, which can be additionally attached after vehicle construction is completed.

It is still another object of the present invention to provide a print antenna which can be attached to overlap a region of a defogging heater conductor on a window glass surface, where a user can select and change its mounting position in order to obtain good antenna performance.

It is still another object of the present invention to provide a print antenna which does not disturb a field of view when it is attached to a window glass.

It is still another object of the present invention to provide a print antenna, a feeder cable of which can be desirably extended when the mounting position of the antenna on a window glass is changed, and which can be attached on either the right or lefthand side of the window glass regardless of the position of the feeder cable.

According to the present invention, an antenna apparatus for a vehicle comprises: an insulating film capable of being adhered to a window glass of the vehicle; an antenna element conductor formed on the insulating film; a feeder terminal provided to the antenna element; and a pair of connector members attached to the feeder terminal and to an end of a feeder cable extending to a communication apparatus.

According to an important aspect of the present invention, the insulating film is transparent, and an adhesive is applied on its rear surface. Therefore, the antenna can be attached to a desired position on a window glass. In addition, a field of view is not disturbed. If a defogging heater conductor is already provided on the window glass, a print antenna can be provided on a region overlapping the heater conductor.

According to another important aspect of the present invention, an antenna element is of unbalanced power feed type, and its feeder terminal and a feeder cable extending to a communication apparatus are coupled through a rotatable coaxial connector. The coaxial feeder cable extends perpendicularly to an axial conductor of the connector.

For this reason, the feeder cable can be desirably extended and is free from disturbance. An antenna position is not restricted by the feeder cable, and a good reception position can be selected.

BRIEF DESCRIPTION OF THE DRAWINGS

The foregoing and other objects, features advantages of the invention will become more apparent upon a reading of the following detailed description and drawing, in which.

DETAILED DESCRIPTION OF THE PREFERRED EMBODIMENT

Figure 1:
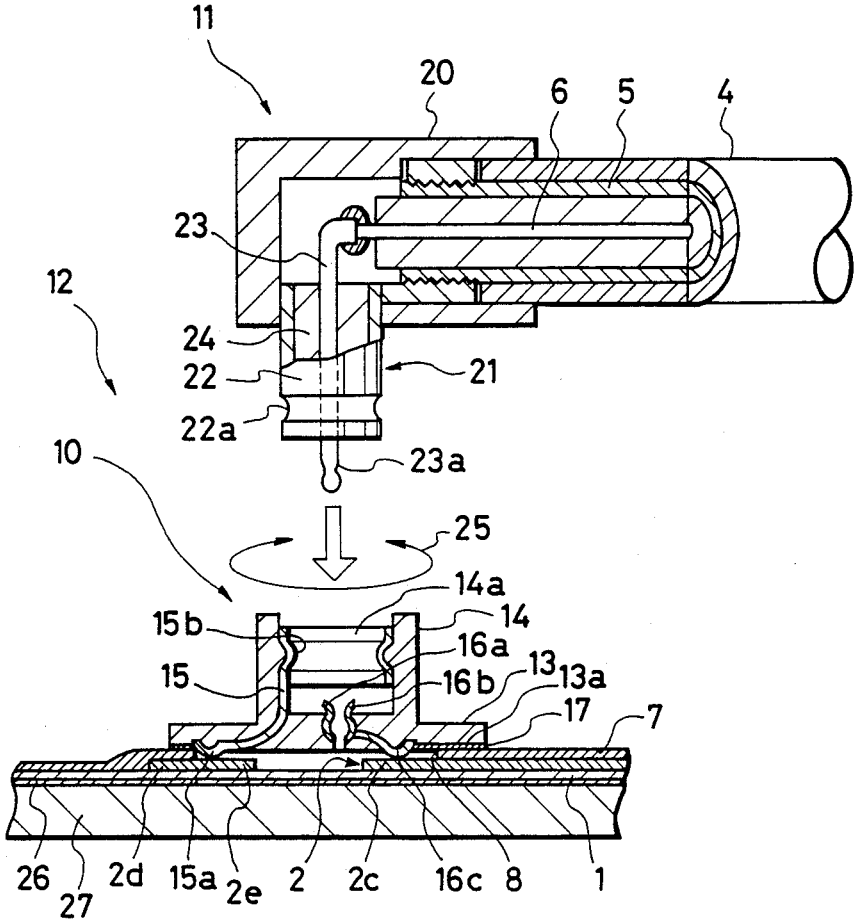
FIG. 1 is a sectional view showing a state wherein an antenna apparatus for a vehicle according to the present invention is adhered on a surface of a window glass.
Figure 2:
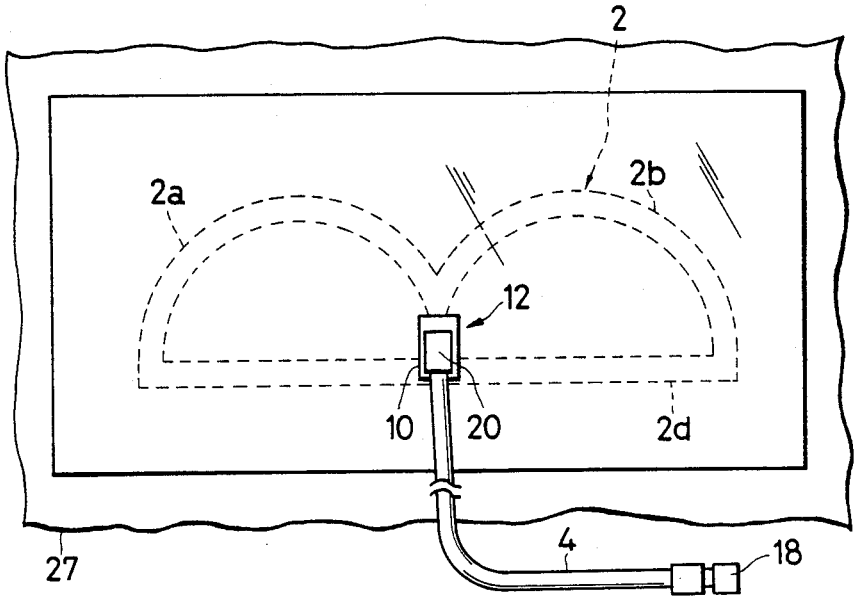
FIG. 2 is a plan view showing an adhesion state of a print antenna.

FIG. 1 is a sectional view showing a state wherein a vehicle telephone antenna apparatus is attached on a rear window glass of a vehicle, and FIG. 2 is a plan view.

Figure 3:
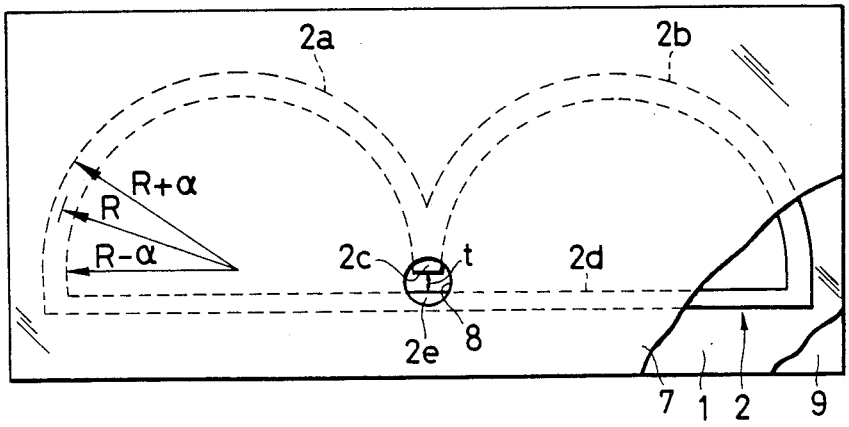
FIG. 3 is a plan view showing an antenna pattern.

The vehicle telephone antenna apparatus is formed by arranging an antenna element conductor (to be simply referred to as an antenna conductor hereinafter) 2 which is tuned in a frequency band (800 MHz to 1 GHz) used for a vehicle telephone on a surface of a transparent insulating film 1. In this case, the antenna conductor 2 has a pattern as shown in FIG. 3. That is, two semicircular conductors **2*a* and 2*b* are connected in a bimodal shape, and a connecting point serves as a feed point 2*c*. Two ends of the semicircular conductors 2*a* and 2*b* are coupled by a linear conductor 2d corresponding to the chord of the semicircle and are grounded. If an effective conductor length of the semicircular conductors 2a and 2b** is about $\lambda/2$, the antenna exhibits biloop antenna-like characteristics having a perimeter corresponding to about 1 wavelength based on an image current by unbalanced power feed.

The widths W of the semicircular conductors 2a and 2b and the linear conductors 2d are increased to obtain good characteristics in a wide range between 820 to 940 MHz. A central radius R of each of semicircular conductors 2a and 2b is about 50 mm, and radii $R \pm \alpha$ of the outer and inner peripheries are respectively 52.5 mm and 47.5 mm ($\alpha = 2.5$ mm). A gap $t = 5$ mm is formed between the connecting point between the semicircular conductors 2a and 2b and the linear conductor 2d.

A ground point 2e is provided at the middle point of the linear conductor 2d, and is connected to an external conductor 5 of a coaxial feeder 4 coupled to a vehicle telephone set (not shown). The feed point 2c provided at the connecting point of the semicircular conductors 2a and 2b is connected to an inner conductor 6 of the coaxial feeder 4, thus performing unbalanced power feed. In this embodiment, as shown in FIG. 3, a transparent insulating film 7 is coated over the antenna conductor 2 to protect it. The conductors 5 and 6 of the coaxial feeder 4 are connected to the antenna conductor 2 through an opening formed in the transparent insulating film 7. These connections are made through a coaxial type connector device 12 consisting of a receptacle 10 and a plug 11, so that an excessive force does not act between the antenna conductor 2 and the coaxial feeder 4 when the coaxial feeder 4 is stretched in every direction.

A body portion of the receptacle 10 serving as a fixed coaxial connector is formed of an insulator, and is formed by integrally projecting a cylindrical projection 14 on the upper surface of a base 13 adhered to the transparent insulating film 7. A plug fit socket 14a is formed inside the cylindrical projection 14, and an annular ground conductor 15 is provided along the inner surface of the socket 14a. A contact 15a connected to the ground conductor 15 extends outside a bottom surface 13a of the base 13. A pair of contact tips 16a and 16b are provided at the center of the bottom portion of the socket 14a. A contact 16c connected to these tips 16a and 16b similarly extends outside the bottom surface 13a.

The contacts 15a and 16c extend in different directions. When the receptacle 10 is fixed to the transparent insulating film 7, the contact 15a is coupled to the ground point 2e of the antenna conductor, and the contact 16c is coupled to the feed point 2c. The receptacle 10 is adhered to the transparent insulating film 7 by applying an adhesive 17 to the bottom surface 13a of the base 13.

The plug 11 serving as a movable coaxial connector is formed by projecting a bayonet 21 from the side surface of a sleeve 20. The central axis of the sleeve 20 is perpendicular to that of the bayonet 21. The sleeve 20 serves as a holding member of the coaxial feeder 4. The bayonet 21 is constituted by an outer conductor, and ah inner conductor arranged along its central axis. A circular cylindrical conductor 22 is the outer conductor, and the outer diameter of the cylindrical conductor 22 is substantially the same as the inner diameter of the ground conductor 15. An inner conductor 23 is formed into a rod shape, and its distal end portion 23a extends outwardly from the cylindrical conductor 22 by a predetermined length. An insulator 24 is interposed between the inner and outer conductors 23 and 22 to insulate them from each other. Since the distal end portion 23a of the inner conductor projects, when the bayonet 21 is inserted in the socket 14a, the cylindrical conductor 22 is fitted in the ground conductor 15 to be electrically connected to each other. In addition, the distal end portion 23a of the central conductor is fitted between the contact tips 16a and 16b, so that they are electrically connected to each other. When the plug 11 is mounted on the receptacle 10, the cylindrical conductor 22 is electrically connected to the ground point 2e, and the inner conductor 23 is electrically connected to the feed point 2c.

The external conductor 5 of the coaxial feeder 4 is connected to the sleeve 20, and the inner conductor 6 thereof is connected to the inner conductor 23 provided at the center of the bayonet 21, so that the coaxial feeder 4 is held in the sleeve 20. The sleeve 20 is formed of a conductive metal such as copper, and is electrically coupled to the cylindrical conductor 22. Therefore, when the receptacle 10 and the plug 11 are connected, the external conductor 5 of the coaxial feeder 4 and the ground point 2e of the antenna conductor 2 are electrically connected to each other, and the inner conductor 6 and the feed point 2c are electrically connected to each other.

Note that as shown in FIG. 2, a plug 18 is attached to the other end of the coaxial feeder 4, and is inserted in a receptacle (not shown) provided to the vehicle telephone set. In this manner, the coaxial feeder 4 can be connected to the vehicle telephone set.

An engaging projection 15b is formed on the inner surface of the ground conductor 15, and an engaging recess portion 22a engaged with the engaging projection 15b is formed in the outer surface of the cylindrical conductor 22, so that the plug 11 is not easily disconnected from the receptacle 10.

An adhesive 26 for adhering the insulating film 1 to the window glass is applied to the rear surface of the insulating film 1, and a release paper 9 is attached to the surface of the adhesive layer. Therefore, after the release paper 9 is released, the rear surface of the insulating film 1 need only be brought into contact with the window glass of the vehicle and can be easily adhered thereto.

Figure 4A:
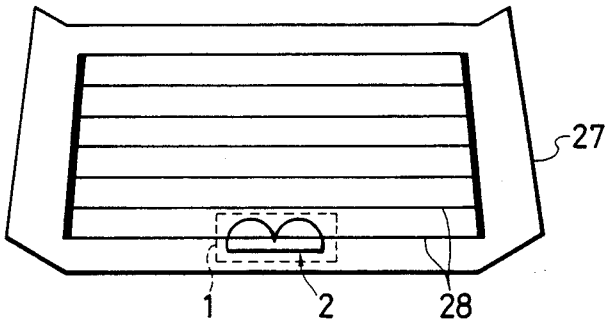
FIGS. 4A and 4B are front views of a rear window glass showing a state wherein the antenna apparatus of the present invention is adhered on the window glass to serve as a window glass antenna.

In an attached state, the insulating film 1 is interposed between the antenna conductor 2 and the surface of a rear window glass 27. Therefore, as shown in FIG. 4A, if the insulating film 1 is adhered on heater wires 28 on a rear window glass 27, the antenna conductor 2 can be mounted without contacting the heater wires 28. Therefore, even if the heater wires 28 are provided, the mounting position of the antenna conductor 2 is not restricted, and a position where good antenna performance can be obtained can be desirably selected.

If the bottom surface 13a of the base 13 is formed to have a curvature corresponding to that of the glass, the receptacle 10 can be attached to the glass surface without forming a gap.

Since the bayonet 21 projects in a direction perpendicular to a connecting direction of the coaxial feeder 4 to the sleeve 20, i.e., the axial direction of the coaxial feeder 4, the coaxial feeder 4 can extend in a direction along the window glass surface. As indicated by an arrow 25 in FIG. 1, since the plug 11 is pivotal about the receptacle 10, no excessive force is applied between the coaxial feeder 4 and the antenna conductor 2 when the coaxial feeder 4 is extended. Therefore, the coaxial feeder 4 can be desirably extended in an arbitrary direction, and the antenna conductor 2 can be attached on either left or right side of the window glass.

Figure 4B:
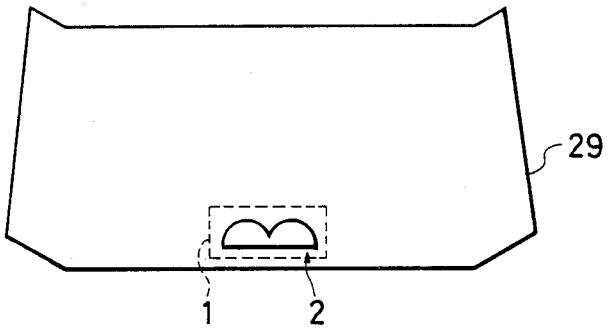
Figure 5A:
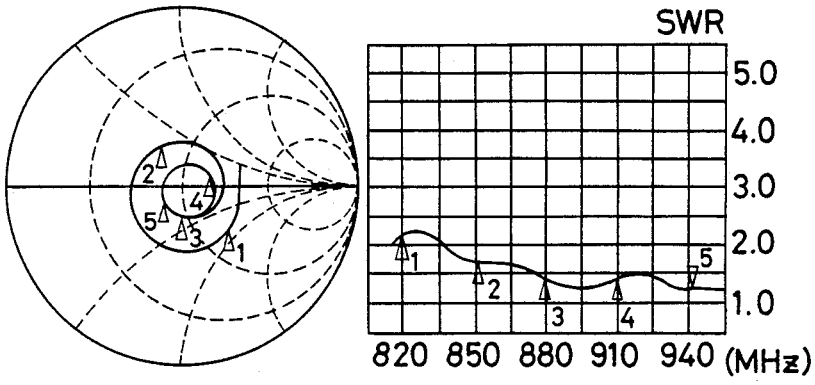
FIGS. 5A and 5B are Smith charts showing impedance characteristics of the antenna and graphs of a standing-wave ratio.
Figure 5B:
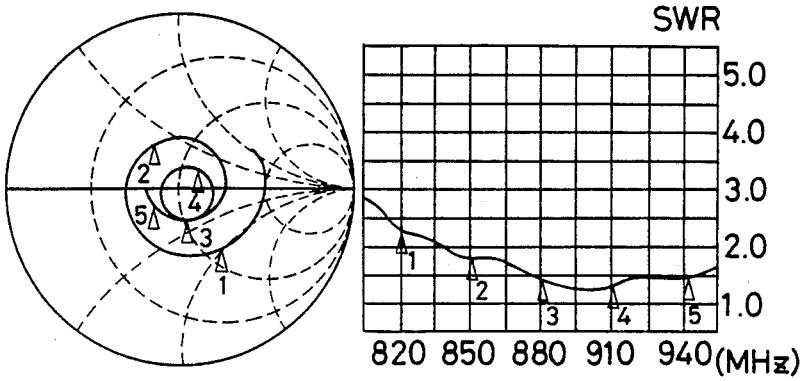
Figure 6A:
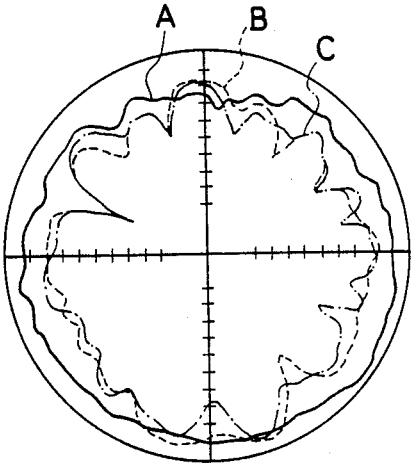
FIGS. 6A to 6G ar directional characteristic diagrams.
Figure 6B:
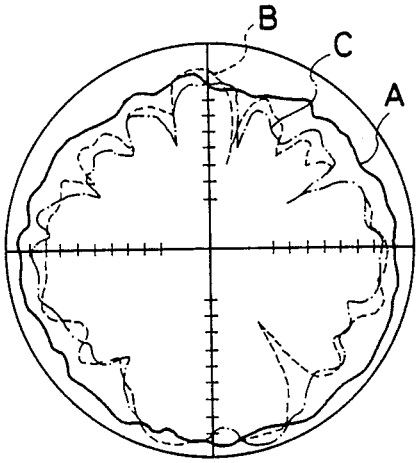
Figure 6C:
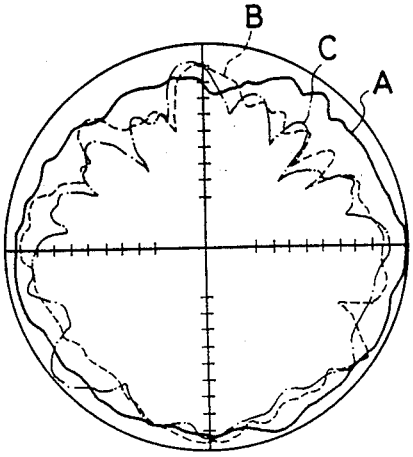
Figure 6D:
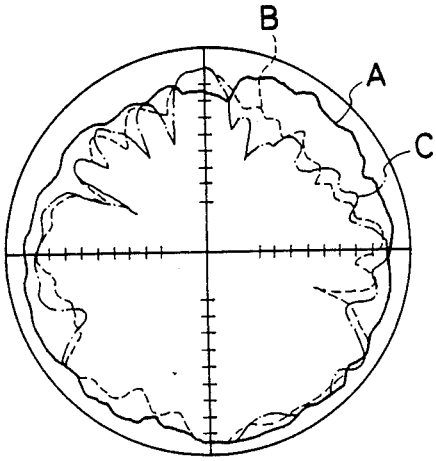
Figure 6E:
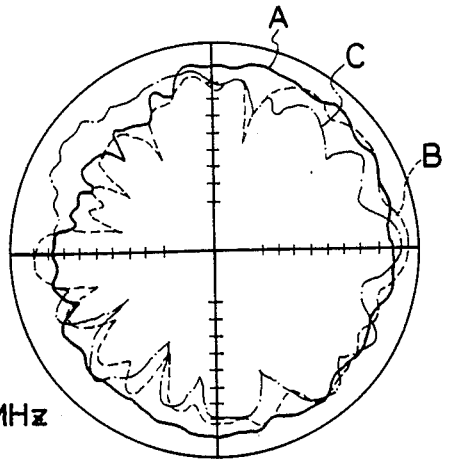
Figure 6F:
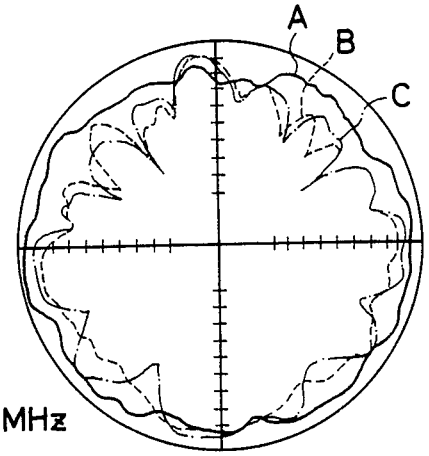
Figure 6G:
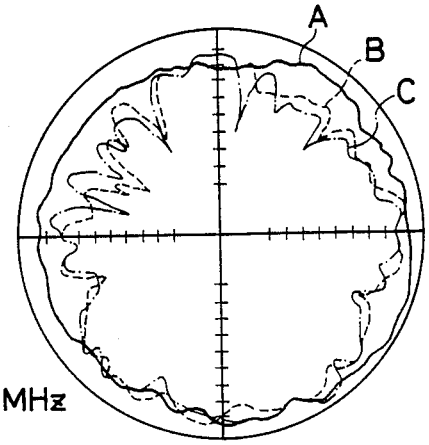

FIGS. 5A and 5B are sets of Smith charts showing impedance characteristics and graphs of a standing-wave ratio (SWR) obtained when the antenna apparatus of this embodiment is attached to the rear window glass 27 provided with the heater wires 28, as shown in FIG. 4A and when the antenna apparatus is attached to a rear window glass 29 with no heater wires 28, as shown in FIG. 4B. As shown in FIG. 5B, when the apparatus is attached, to the rear window glass 29 without heater wires, the standing-wave ratio SWR is slightly degraded with respect to a reference level of 1.0 in a low-frequency range (equal to or lower than 820 MHz) and in a high-frequency range (equal to or higher than 940 MHz). However, in a necessary range of 820 to 940 MHz, the low SWR is exhibited in both the cases with and without the heater wires, and matching with the coaxial feeder 4 is good.

FIGS. 6A to 6G show frequency-directional characteristic graphs in the vehicle telephone band. A characteristic curve A indicated by a solid curve represents characteristics of a rear pole antenna. A characteristic curve B indicated by a dotted curve and a characteristic curve C indicated by an alternate long and dashed curve show characteristics of the antenna apparatus of this embodiment. The characteristic curve B shows a case wherein the apparatus is attached to the rear window glass 27 provided with the heater wires 28, and the characteristic curve C shows a case wherein the apparatus is attached to the rear window glass 29 without the heater wires.

As can be understood from FIGS. 6A to 6G, a reception gain of the antenna apparatus of this embodiment is slightly lower than that of the rear pole antenna in a right-and-left direction, but is almost the same in a rear direction. However, the reception gain of this embodiment is higher than that of the rear pole antenna in a front direction (upward direction in the drawing).

In this embodiment, since the connector device 12 is constituted by the receptacle 10 and the plug 11, the coaxial feeder 4 and the antenna conductor 2 can be easily attached/detached. Therefore, for example, if the apparatus of this embodiment is replaced with the insulating film 1 of another antenna pattern conductor 2, the coaxial feeder 4 need not be replaced. If a plurality of films 1 are arranged on the window glass, the coaxial feeder 4 can be connected to a desired one of antenna conductors 2 on the films 1. The connector device 12 of this embodiment is of detachable type but need not be detachably arranged. When the connector device 12 is of detachable type, the plug 11 may be provided to the insulating film 11 side, and the receptacle 10 may be provided to the coaxial feeder 4 side.

When the pattern of the antenna conductor 2 is tuned with a frequency band other than the vehicle telephone band, e.g., a television or FM radio broadcast band, the antenna apparatus of this embodiment can be used as a reception antenna for the broadcast waves of these frequency bands.

The transparent insulating film 7 for protecting the antenna conductor 2 need not be coated. If the transparent insulating film 7 is coated and a transparent conductive film is further coated on its upper portion, radiation hazards to passengers in a vehicle can be prevented.

While a. preferred embodiment has been described, variations thereto will occur to those skilled in the art within the scope of the present inventive concepts which are delineated by the following claims.

What is claimed is:

1. An antenna apparatus for a vehicle, comprising:

first and second layers of transparent insulating film, said first layer having adhesive applied to its outside surface to attach the film to a vehicle window;

an antenna element conductor interposed between said first and second film layer and comprising a feeder terminal conductor and a ground terminal conductor, said second film layer having an opening therein to expose said feeder terminal conductor and said ground terminal conductor;

a pair of detachably coupled coaxial connectors comprising a plug member and a receptacle member and engaging means for preventing the connectors from being easily disconnected, said coaxial connectors further comprising an inner contact and an outer contact to which said feeder terminal conductor and ground terminal conductor are respectively connected, one of said connectors being mounted on said second film layer with its plug-in axis perpendicular to the surface of the film; and a coaxial feeder cable attached to the other of said coaxial connectors so as to extend perpendicularly to the plug-in axis of said coaxial connectors, said antenna element conductor being subjected to unbalanced power feed with a communication apparatus through said coaxial feeder cable.

2. An apparatus according to claim 1, wherein said connector on the side of said feeder terminal comprises a coaxial receptacle, and said connector on the side of said feeder cable comprises a coaxial plug.

3. An apparatus according to claim 1, wherein said other connector includes a sleeve for holding said coaxial feeder cable in a direction perpendicular to the plug-in axis of said other connector.

4. An apparatus according to claim 3, wherein said other coaxial connector is pivotal about its plug-in axis when said coaxial connectors are coupled.

5. An apparatus according to claim 1, wherein said antenna element conductor comprises at least two semi-loop conductors having a connecting point and two end points, said feeder terminal provided at said connecting point, a linear conductor connecting the end points of the semi-loops to become a chord of said semi-loop conductors, and a ground terminal provided at the central portion of said linear conductor to be separated from said feeder terminal by a small gap, a core conductor of a coaxial feeder cable is coupled to said feeder terminal, and said ground terminal is connected to an outer conductor of the coaxial feeder cable, so that said antenna element conductor is subjected to unbalanced power feed.

6. An apparatus according to claim 5, wherein each of said semi-loop conductors has a semicircular shape, and an arc length of each semicircle corresponds to a $\frac{1}{2}$ wavelength of a communication frequency.

7. An apparatus according to claim 6, wherein the communication frequency is in a vehicle telephone band.

8. An apparatus according to claim 1 wherein said engaging means comprises an annular projection portion formed on the inner surface of said receptacle member and an annular recessed portion formed on the outer surface of said plug member, said projection and recessed portions being arranged so that said projection portion fits within said recessed portion when said coaxial connectors are coupled.

* * * * *